United States Patent [19]

Titchenal

[11] 4,453,370

[45] Jun. 12, 1984

[54] SQUARE ENDED BAG

[75] Inventor: Oliver R. Titchenal, North Ridgeville, Ohio

[73] Assignee: Basic Packaging Systems, Inc., Avon Lake, Ohio

[21] Appl. No.: 301,762

[22] Filed: Sep. 14, 1981

[51] Int. Cl.[3] ..... B65B 43/08; B65B 43/04; B31B 49/04; B31B 1/22

[52] U.S. Cl. ..... 53/455; 53/468; 493/936; 493/929

[58] Field of Search ..... 53/455, 452, 450, 468; 493/936, 929, 193–198, 218, 213

[56] References Cited

U.S. PATENT DOCUMENTS

| | | | |
|---|---|---|---|
| 3,395,622 | 8/1968 | Kugler | 493/936 X |
| 3,534,666 | 10/1970 | Maccherone | 493/194 |
| 3,537,360 | 11/1970 | Farnam | 493/936 X |
| 3,599,538 | 8/1971 | Piazze | 493/194 |
| 3,646,856 | 3/1972 | Worndl | 493/193 X |
| 3,855,907 | 12/1974 | Johnson et al. | 53/455 X |
| 3,896,708 | 7/1975 | De Vries | 493/936 X |
| 3,896,709 | 7/1975 | Brinkmeier | 493/936 X |
| 4,216,639 | 8/1980 | Gautier | 53/455 X |

*Primary Examiner*—Horace M. Culver

*Attorney, Agent, or Firm*—Pearne, Gordon, Sessions, McCoy, Granger & Tilberry

[57] ABSTRACT

Open mouth square ended bags are formed from a tube-like band and in a chain with the back wall and top end of each bag partially sealed together from each side wall to provide an open mouth therebetween. Each bag in turn may be filled through the mouth located between the back wall and top end, the bag expanding forwardly from the back wall by expanding gussets in the top and bottom ends.

12 Claims, 15 Drawing Figures

SQUARE ENDED BAG

BACKGROUND OF THE INVENTION

1. Field to Which Invention Relates This invention relates to a chain of square ended bags, the method of making and filling the square ended bags and to an open mouth square ended bag included in the chain of square ended bags and removable therefrom by separating each successive open mouth square ended bag from the chain of bags. More specifically the invention is directed to an open mouth square ended bag wherein the back wall and top end are partially sealed together from each seal side of the bag towards the opposite side of the bag a distance less than half the distance between the sides, thereby defining an open mouth through which the bag may be filled from the top and between the back wall and the top end.

2. Description of the Prior Art

In prior open mouth bags of the square end type, the mouth of the bag has extended from one side wall to the other side wall. The closest prior art known to the present inventor is his own, Oliver R. Titchenal, U.S. Pat. No. 3,559,874 patented Feb. 2, 1971 for Series Bag Construction, FIGS. 14 through 20.

Other square ended bags wherein the ends are substantially closed, but are not considered to be open mouth bags, but which are considered to be square ended bags made from a film tube, are Elwin David Jones, U.S. Pat. No. 3,548,722, E. D. Jones, U.S. Pat. No. 3,482,762, and John Warndell, U.S. Pat. No. 3,646856.

SUMMARY OF THE INVENTION

The present invention relates to a chain of open mouth square ended bags constructed from a single elongated band of sealable flexible film, and to the method of making and filling each individual open mouth square ended bag as well as to the construction of each individual square ended bag.

One of the objects of the invention is to provide an open mouth square ended bag which is constructed from a sealable flexible film with the corners and the perimeter of the open mouth sufficiently strong to withstand tearing of the seal or weld during filling and sealing of the bag.

Another object of the present invention is to provide a chain of open mouth square ended bags constructed from a single elongated band of sealable flexible film, wherein each bag has its back wall and top end sealed together with at least one closing seal extending from each seal side of the bag towards the opposite seal side thereof a distance less than half the distance between the seal sides, and thereby defining an open mouth through which the bag may be filled from the top and between the back wall and the top end.

A further object of the invention is to provide a chain of open mouth square ended bags interconnected by an elongated longitudinal portion of the band located along the back walls and top ends of all of the bags and with the seal side of each bag breakably joined to the closest seal side of the next adjacent bag in the chain.

A still further object of the invention is to construct from a single elongated band of sealable flexible film, a chain of open mouth square ended bags which are resistant to tear at the mouth during filling thereof with a product, and with each bag in the chain successively being able to assume its square ended form during filling with a product and prior to sealing thereof either before or after it is separated from the next adjacent bag in the chain.

Other objects and advantages may be observed from the following description of the invention in conjunction with the several drawings.

DESCRIPTION OF THE PREFERRED EMBODIMENTS

Figure 1:
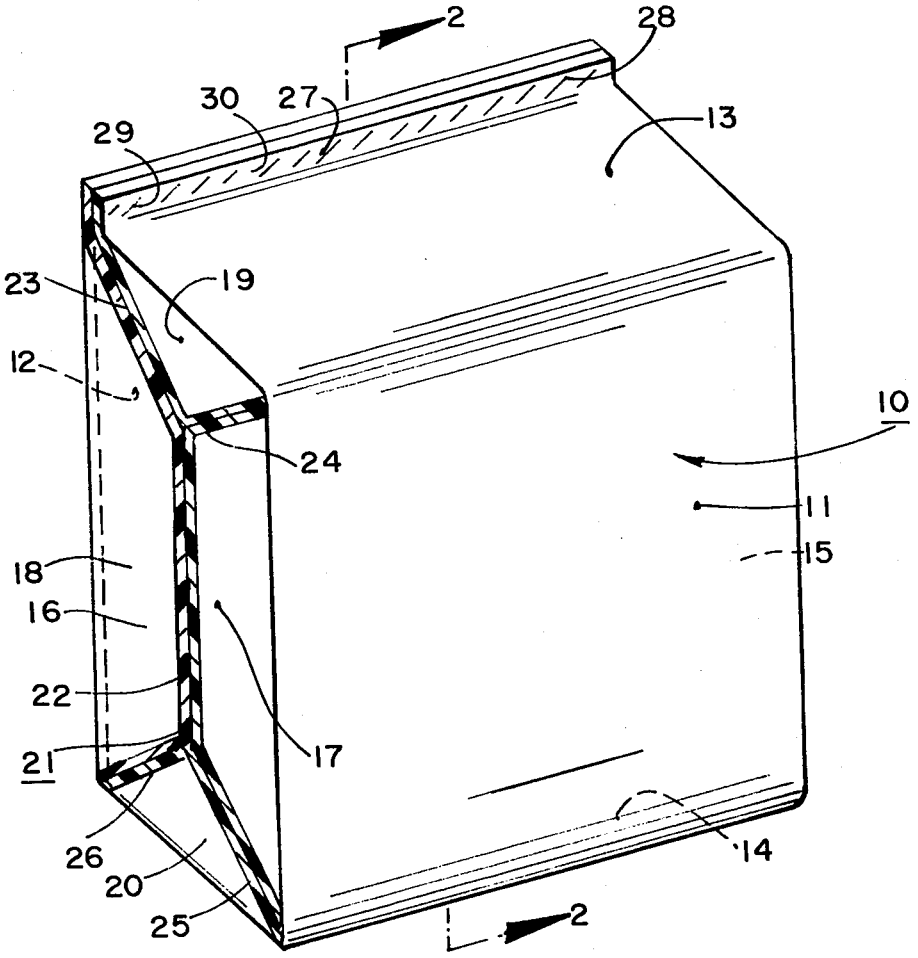
FIG. 1 is an isometric view of a product filled and sealed square ended bag.

FIG. 1 is an isometric view showing a completed product filled and square ended bag 10 having a front wall 11, a back wall 12, a top end 13, a bottom end 14, a fore seal side 15, and an aft seal side 16. The fore seal side 15 and aft seal side 16 are substantially identical to each other. As illustrate in FIG. 1, the aft seal side 16 consists of a front wall portion 17, a back wall portion 18, a top end portion 19, and a bottom end portion 20 welded or sealed together by a side seal 21.

As best illustrated in FIG. 1, the side seal 21 includes a center side seal leg 22 interconnecting front wall portion 17 and back wall portion 18 and extending in a plane parallel with the planes of the front wall 11 and back wall 12; a first side seal leg 23 interconnecting back wall portion 18 and top end portion 19 and extending from the upper terminus of center side seal leg 22 to the corner intersection of top end 13 and back wall 12; a second side seal leg 24 interconnecting top end 19 and front wall portion 17 and extending from the upper terminus of center side seal leg 22 to the corner intersection of top end 13 and front wall 11; a third side seal leg 25 interconnecting front wall portion 17 and bottom end portion 20 and extending from the upper terminus of center side seal leg 22 to the corner interconnection of front wall 11 and bottom end 14, and a fourth side seal leg 26 interconnecting back wall portion 18 and bottom end portion 20 and extending from the lower terminus of center side seal leg 22 to the corner interconnection of bottom end 14 and back wall 12. Because the side seal on the fore seal side 15 is substantially identical to the side seal on the aft seal side 16, the specific legs thereof, and the portions being sealed together are not separately numbered in the drawings. Back wall 12 and top end 13 are sealed together along their juncture by a closing seal 27 including a fore closing seal leg 28, an aft closing seal leg 29 and a center closing seal leg 30 interconnected generally in a single line parallel to back wall 12 and top end 13. The details and purposes of the fore closing seal leg 28 and the aft closing seal leg 29 will be described later herein.

Bag 10 is preferably constructed from a single elongated band, such as an elongated flexible film of polyethylene, nylon, polypropylene, or other polymerics, which can be heat sealed or welded, adhered, cohered or otherwise secured to itself, like materials, or other film materials along the preselected lines by heat sealing, welding, gluing or other adhering means which provide structures having mechanical and property equivalents to each other so as to make side seal 21 and closing seal 27 capable of keeping a product filled square ended bag 10 intact during shipment and usage. The band is preferably in the form of a flattened tube of film, but in some instances may be in the form of a relatively long film folded longitudinally upon itself in flattened tube-like fashion. The band can also be made from multiply or laminated films and from films containing fibrous materials such as paper, cloth, and the like which can be secured to itself along seals by hot melt gluing or other adhesive means commonly known in the industry. In addition, the exact dimensions, including thickness of film from which the walls, ends, and sides of a bag are manufactured and the dimensions of the completed bag may be preselected for the specific product and desires of the manufacturer or user of the bag, without departing from the spirit and scope of the invention.

Figure 2:
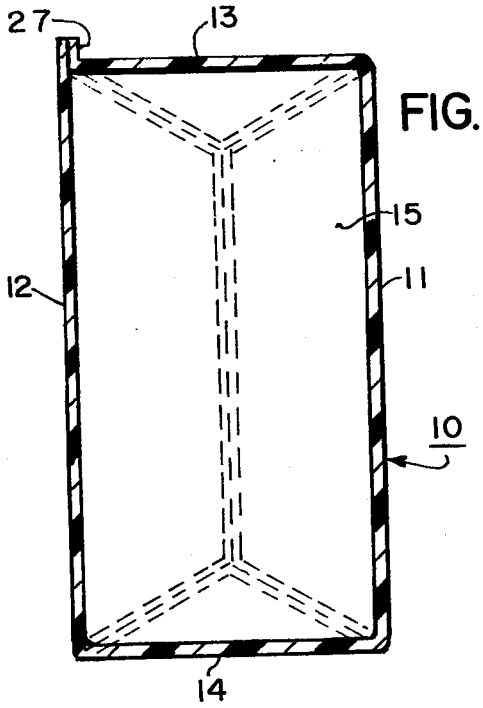
FIG. 2 is a sectional view along the line 2—2 of FIG. 1 but with the product omitted from the bag.
Figure 3:
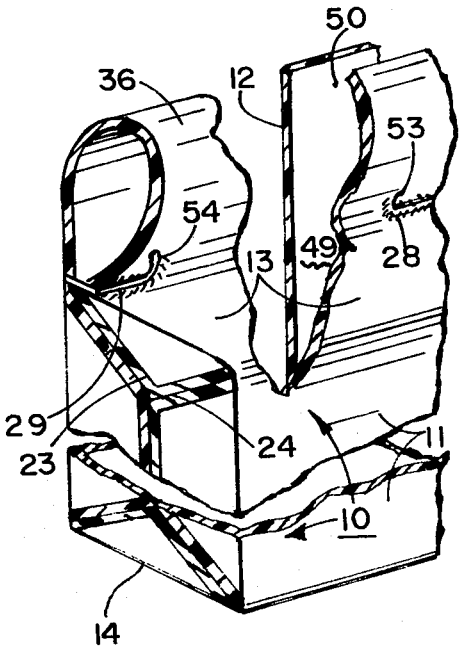
FIG. 3 is an isometric view partly in section of an open mouth square ended bag.
Figure 4:
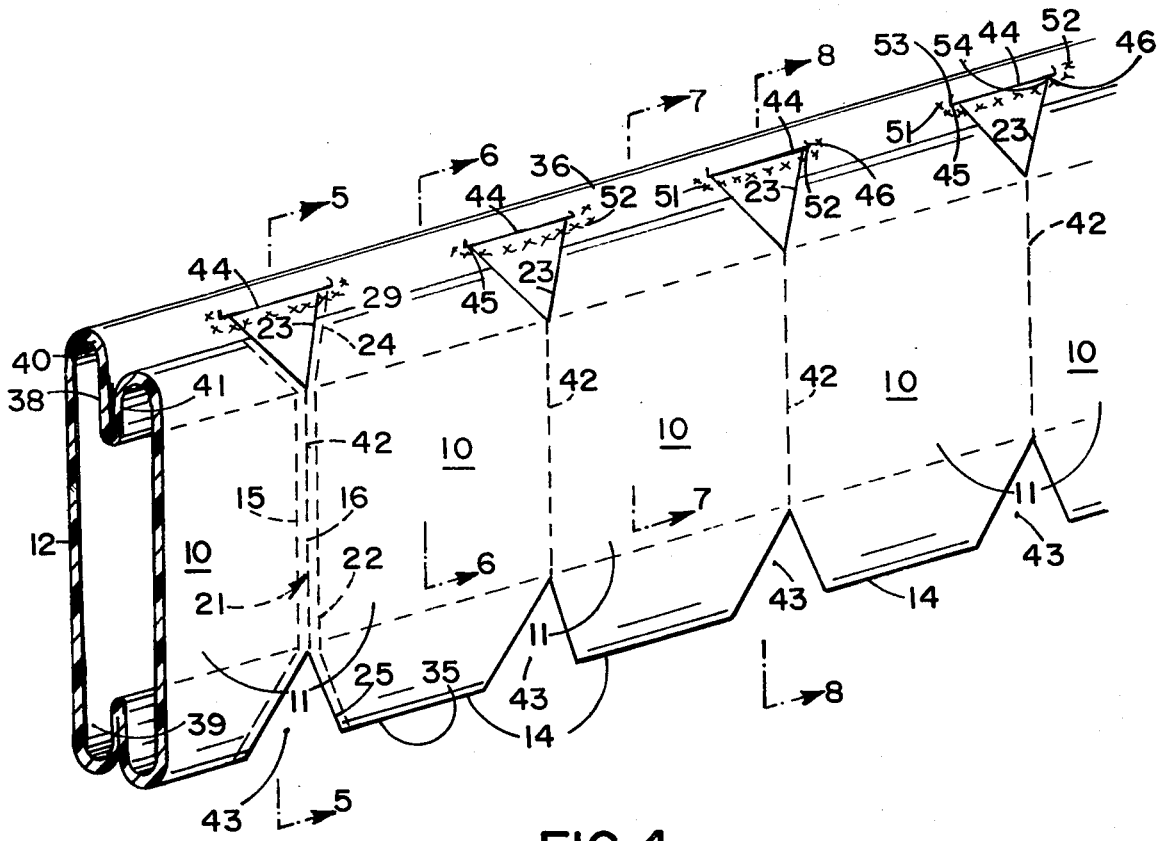
FIG. 4 is a perspective view schematically illustrating the steps in the method of making a chain of open mouth square ended bags.
Figure 5:
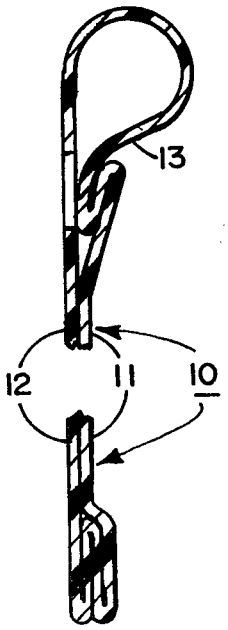
FIGS. 5–8, are sectional views along the lines 5—5, 6—6, 7—7, and 8—8, respectively, of FIG. 4.
Figure 6:
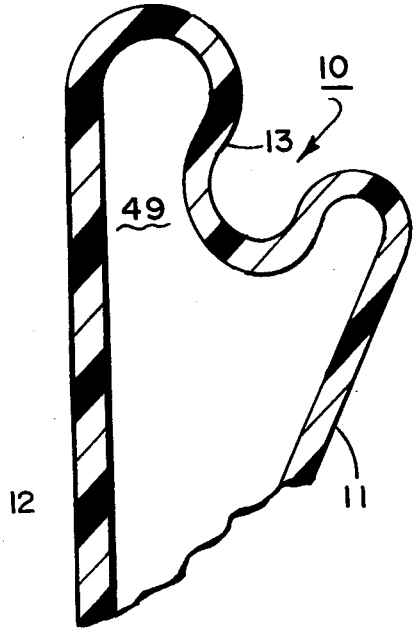
Figure 7:
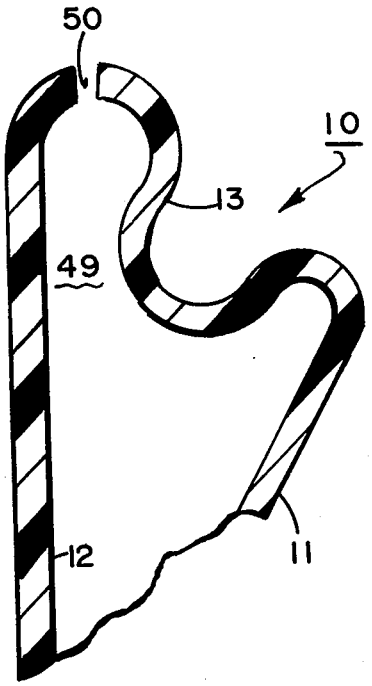
Figure 8:
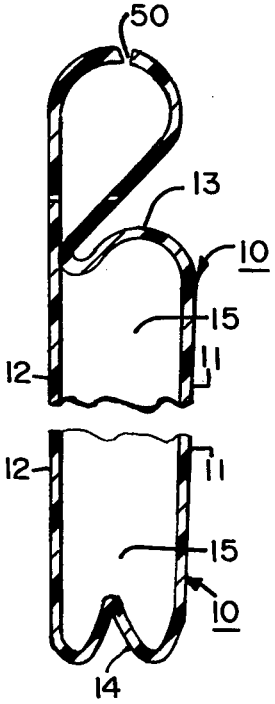

Having thus described a completed, product filled, square ended bag as illustrated in FIGS. 1 and 2, additional details of the structure of bag 10 prior to its being product filled and sealed, and a chain of successive bags will now be described. In FIG.3, there is illustrated a single open mouth square ended bag 10, and in FIG. 4 there is illustrated a chain 35 of bags, comprising a plurality of bags interconnected by an elongated longitudinal strip portion 36. FIG. 4 further illustrates schematically the steps in the method of making a plurality of bags 10 from a single elongated tube of sealable flexible film 37. Schematically the tube 37 enters FIG. 4 from the left side thereof and finished bags 10 exit from the right. In making the chain of bags 35, the tube 37 is first provided with a top gusset 38 and a bottom gusset 39. Top end 13 of bag 10 emanates from top gusset 38 and bottom end 14 of bag 10 emanates from bottom gusset 39. Elongated longitudinal strip portion 36 is defined by having the back half 40 of top gusset 38 of greater dimension than andextending above the front half 41 of top gusset 38 the front side of the top gusset 38 is of a dimension substantially equal to the front and back sides of the bottom gusset 39. In addition, first side seal leg 23 and second side seal leg 24 may be prevented from merging and sealing or welding together and third seal leg 25 and fourth seal leg 26 may be prevented from sealing together by providing the outer surface of top gusset 38 and bottom gusset 39 with a coating or spacing means which permits welding two adjacent layers of film and prevents all four layers of film in the gusset from welding together. The preventing of the welding of first side seal leg 23 to second side seal leg 24 and third side seal leg 25 to fourth side seal leg 26 while welding side seal legs 23, 24, 25 and 26 is commonly known in the industry and not a part of this invention. FIG. 4 best illustrates that during the making of the bag 10 from tube 37 aft seal side of one bag 10 is breakably connected by a perforated connection 42 to fore seal side 15 of the next adjacent or trailing bag 10, while elongated longitudinal strip portion 36 interconnects the back half 40 of gusset 38 of the two next adjacent bags 10 in the chain 35 of bags. In addition to and extending from perforated connections 42 is a notch 43 cut through bottom gusset 39 and a cut 44 extending through the back half 40 of gusset 38 and also through front half 41 of gusset 38. Cut 44 includes a fore slit 45 extending parallel with and contiguous to fore closing seal leg 28 and an aft slit 46 parallel to and contiguous to aft closing seal leg 29. All cuts 44 and perforations 42 are positioned such that they will be on the outside of each finished bag 10 and so that they will not provide holes in the walls, top ends, or seal sides of bag 10.

In chain 35 of bags, while each bag 10 has its top end 13 and bottom end 14 provided respectively with its top and bottom gusset 38 and 39, and the front wall 11 and back wall 12 are collapsed against each other, the fore closing seal leg 28 and aft closing seal leg 29 cooperatively define an open mouth 49 between back wall 12 and top end 13. The open mouth 49 is further from bottom end 14 than the top-to-bottom length of front wall 11. Also neither fore slit 45 nor aft slit 46 merges with open mouth 49. Preferably, elongated longitudinal strip portion 36 is severed longitudinally at 50 so as to allow easy access to open mouth 49. This longitudinal severing at 50 is preferably completed after the bag 10 has been provided with all side seals and the fore and aft seal legs and when the bag is ready to be filled with product. If necessary the longitudinal severing of the longitudinal strip portion 36 or its equivalent could be obtained earlier in the manufacture and before the side seals and perforations between adjacent side walls of adjacent bags are made, providing means are provided during manufacturing to maintain proper alignment of the film for welding or sealing, perforating and cutting operations. For example, the band could be a relatively long film folded longitudinally along itself in flattened tube like fashion to provide the equivalent of a tube slit as at 50.

Referring specifically to FIGS. 3 and 4 of the preferred embodiment of the invention, fore closing seal leg 28 and aft closing seal leg 29 terminate at their proximate ends, which are next adjacent open mouth 49, in upturned seal portions 51 and 52, respectively. Fore slit 45 and aft slit 46 terminate in upturned slit portions 53 and 54, respectively. These upturned slit portions 53 and 54 are next adjacent upturned seal portions 51 and 52, and thus direct any possible tearing of elongated longitudinal strip portion 36 during the filling and sealing of bag 10 in a direction away from closing seal 27. The upturned seal portions 51 and 52 and the upturned slit portions 53 and 54 extend in directions generally parallel to the line of travel of product through mouth 49, and thus perpendicular to the extent of closing seal legs 28 and 29. These upturned seal portions 51 and 52 greatly strengthen the bag 10 immediately adjacent the open mouth so that it does not readily tear during filling of the bag. In addition, and after product has been filled into the bag, they assist in maintaining alignment of top end 13 and back wall 12 during the sealing at center closing seal leg 30.

It is noted that since the mouth 49 is next adjacent back wall 12, it is preferable to maintain back wall 12 in a generally fixed attitude and to allow front wall 11, top end 13, bottom end 14, fore seal side 15, and aft seal side 16 to change their attitudes and position during the depositing of product into bag 10 through open mouth 49.

Figure 9:
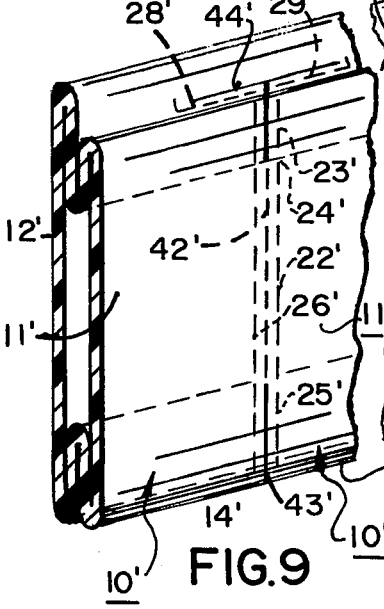
FIGS 9–15 inclusive are perspective views of various modified constructions of open mouth square ended bags.

In the modification illustrated in FIG. 9, the first side seal leg 23', second side seal leg 24', third side seal leg 25', and fourth side seal leg 26' are in the straight line extension of center side seal leg 22'. Fore and aft closing seal legs 28' and 29' extend towards each other in a common line and are separated to provide an open mouth therebetween. Also, there is provided a straight line cut 43' and a "T" shaped cut 44' with the trunk of the "T" shape cut 44' and the notch 43' being in a straight line with and extended from opposite ends of the perforated connection 42.

The elongated longitudinal strip portion 36 may be cut from the completed chain of bags, preferably at the time of filling, so as to aid in the separation of each successive bag as it is filled. The completed filled and sealed bag then appears as shown in FIG. 1.

Figure 10:
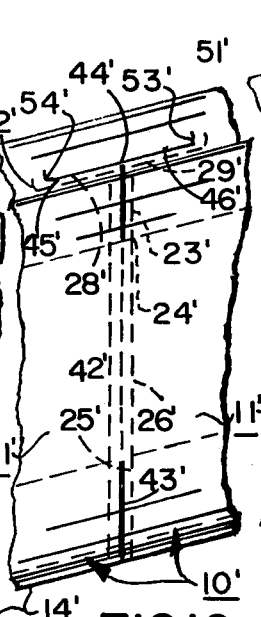
Figure 11:
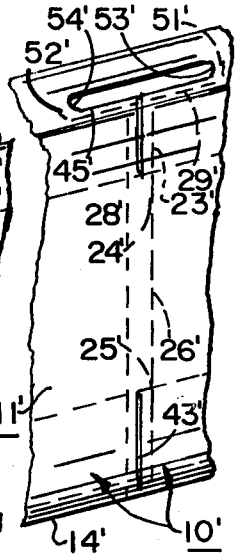

FIGS 10 and 11 illustrate other modifications wherein the fore closing seal leg 28' and aft closing seal leg 29' in a bag 10 terminate at their distal ends in upturned seal portions 51' and 52'. Foreslit 45' and aft slit 46' also terminate at their distal ends in upturned slit portions 53' and 54'. It is noticed in each of these modifications of FIGS. 9, 10, and 11 that the end result after filling and sealing, is a bag 10 having a somewhat square ended shape but with conical shaped protrusions or corners sticking out at every corner thereof.

Figure 12:
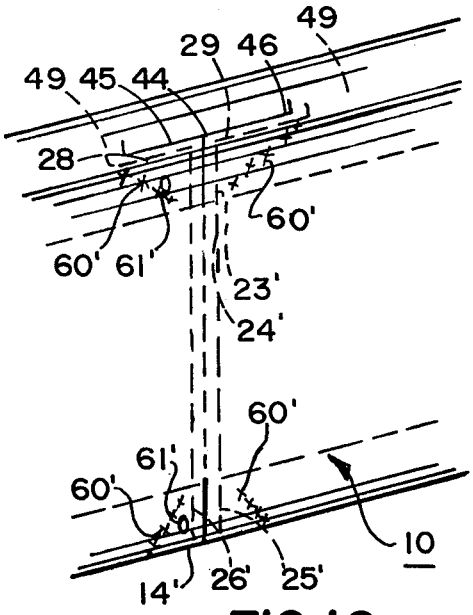

Normally, such conical shaped protrusions are not desired, but it is anticipated that in some instances they may be found useful in stacking bags together to provide air spaces between adjacent stacks of bags. Product in a filled bag exerts forces in all directions on the walls of the bag. Such forces may be amplified in the conical shaped protrusions and may even break the bag at the corner by piercing the weld or seal. To retard this when heavy products are in the bag, and as illustrated in the modification in FIG. 12, there are provided diagonal seals, as at 60' in addition to the seals in any of the modifications of FIGS 9–11 inclusive. These diagonal seals 60' do not merge at either end with the nearest side seal legs 23', 24', 25', or 26' or with the closing seal legs 28' and 29', but are purposely free and separated therefrom to allow gases to escape therebetween while the diagonal seals take the brunt of product forcing itself towards the corners of the bag. If desired, vents may also be provided as at 61 so gases escaping past the diagonal seals may escape and allow the protruding corners to remain unfilled and in a collapsed state rather than becoming filled and somewhat conical in shape.

In those instances wherein the side seal legs 25' and 26' are welded together and diagonal seals 60' are used, the collapsed protruding corners formed thereby are held tight against the respective fore and aft seal sides of the bag 10.

Figure 13:
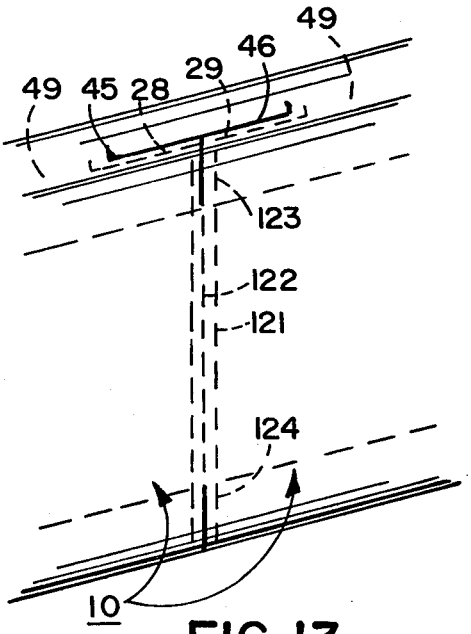
Figure 14:
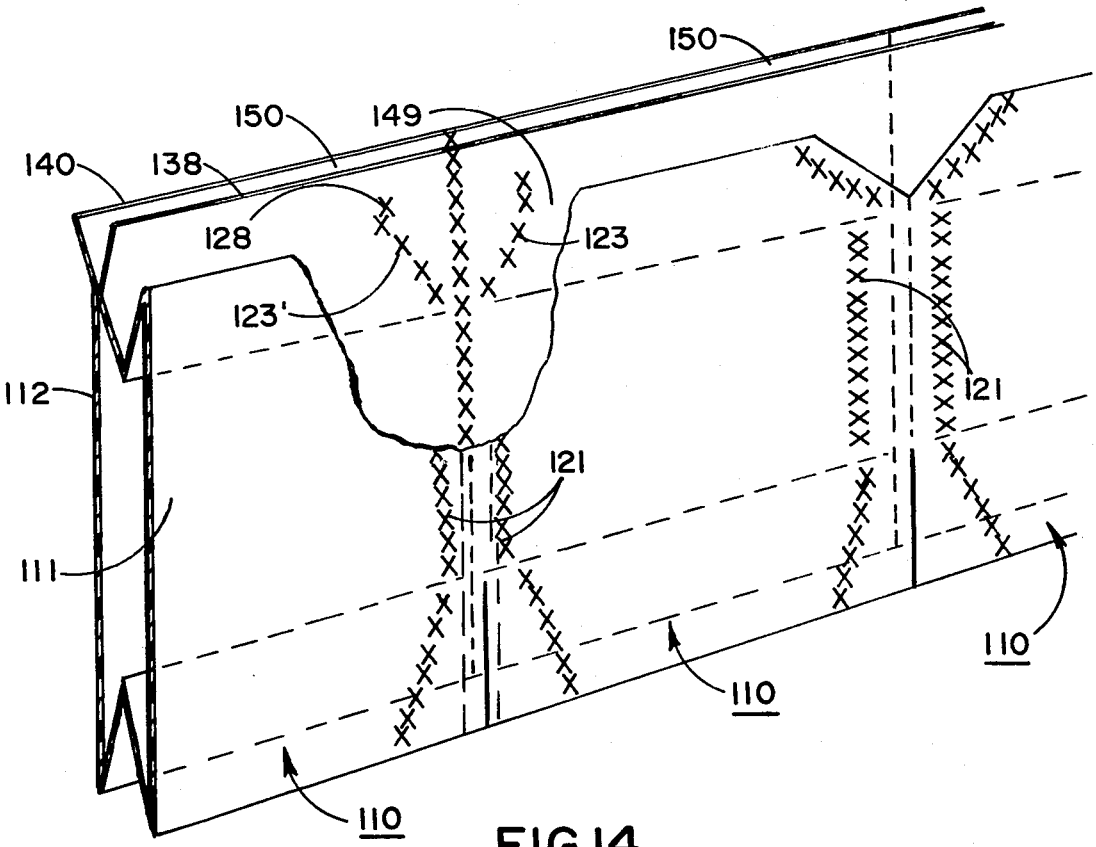

In modification in FIG. 13, side seal 121 welds all four sides of the top gusset together and all four sides of the bottom gusset together. this forms a unique bag which has v-shaped pockets, one at each end of each side of the bag, when the bag has been product filled and sealed. Thus, a single side seal 121 has a top gusset welding leg 123 which welds the back wall to the back half of the top end to the front half of the top end to the front wall, a bottom gusset welding leg 125 which welds the back wall to the back half of the bottom end to the front half of the bottom end to the front wall, and a center side seal leg 122 which welds only the back wall to the front wall. The center side seal leg 122 thus welds two plies of film while the top and bottom side seal legs 123 and 125 weld four plies of film. As in the modifications of FIGS. 1–12 there are closing seal legs 28 and 29 joining the back wall to the top end and forming a mouth 49 therebetween. Also fore slit 45 and aft slit 46 allow expanding of the bag during filling, as in the preferred embodiment while the closing seal legs 28 and 29 strengthen the bag next adjacent the mouth. In FIG. 14 there is illustrated another modification wherein the top of the back half 140 at the top gusset 138 has been slit, as at 150, to provide an open mouth 149. In this instance fore closing seal leg 128 and aft seal closing leg 129 merge with the respective diagonal side seal legs 123 and 123' and extend therewith and therefrom upwardly towards the top of back wall 112 and above top end 113 to reinforce the bag on each end of mouth 149 which is therebetween. Also, the sections 142 between side seals 121 extend through the back half of the top gusset and to the top edge at the slit 150. The front half of the top gusset may be notched or cut as desired between the fore and aft side seal legs therein.

Figure 15:
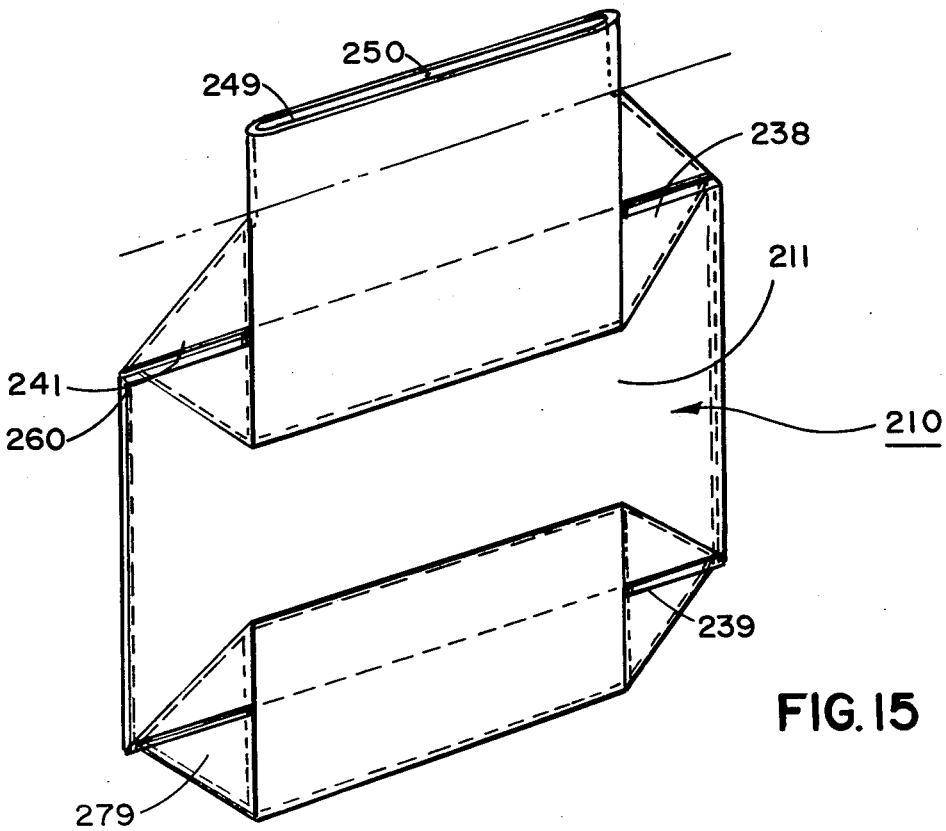

In FIG. 15 there is illustrated an open mouth square ended bag 210 prior to filling and sealing and after the back half of the top gusset has been slit at 250. The bag 210 has the front half 241 of the top gusset 238 turned down as at 238 and overlying front wall 211 so as to provide for hanging the bag on a support (not shown) which may extend between the downturned gusset and front wall. This provides a reference line 260 or a crease line to position the bag for filling through the open mouth 249. The bottom gusset 279 may also have the front half turned up if desired and against the front wall 211. After the bag 210 has been filled with a product, it may be sealed as hereinbefore described and the front wall may be expanded outwardly from the back wall, as in the preferred embodiment of the invention, during filling.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention as hereinafter claimed.

What is claimed is:

1. The method of making a chain of square ended bags each having a mouth and front and back walls, gusseted top and bottom ends and fore and aft seal sides from an elongated band, said method comprising the steps of:

(a) providing the band with overlying front and back walls and with longitudinal top and bottom gussets of dimensions such that both sides of the bottom gusset are of substantially equal dimension and the back side of the top gusset is of greater dimension than the front side thereof to form a longitudinally elongated portion of the band, and said front side of the top gusset is of a dimension substantially equal to the dimension of either side of the bottom gusset;

(b) forming continuous side seal legs of equal length at least part way across each of the gussets and simultaneously across the band between the gussets;

(c) forming closing seal legs in the back side of the top gusset and longitudinally of the band from the ends of the side seal legs and extending across the back side of the top gusset with each closing seal leg extending a distance less than one half the length of the back wall of the bag and thereby providing a mouth between the closing seal legs and the back wall and top end of the bag and also in the longitudinally elongated portion of the band in the back side of the top gusset; and (d) repeating steps b and c at a longitudinally spaced distance from the aforesaid seals to thereby form a series of bags in said band.

2. The method of claim 1 including:

(a) cutting the band through the back side of the top gusset along a line transverse to the band and parallel to the side seal legs and thence longitudinally to the band a distance less than one half the length of the back wall of the bag and substantially contiguous to the closing seal legs.

3. The method of making product filled and sealed square ended bags including first making a chain of square ended bags as set forth in claim 1, and thereafter successively:

(a) filling each successive bag through the mouth with product and causing the front wall to separate from the back wall and the gussets to expand into top and bottom ends and expand into the side seal legs to form portions of the band of film into sides of the bag;

(b) sealing the back wall to the top end; and (c) finally separating the filled bag from the next adjacent bag by the aid of perforations between adjacent side seals of adjacent bags.

4. The method of making product filled and sealed square ended bags including first making a chain of square ended bags as set forth in claim 2, and thereafter successively:

(a) filling each successive bag through the open mouth with product and causing the front wall to separate from the back wall and the gussets to expand into top and bottom ends and expand into the side seal legs to form portions of the band of film into sides of the bag;

(b) sealing the back wall to the top end; and (c) finally cutting the elongated portion of the top gusset outside of the seal legs and the bag and separating the filled bag from the next adjacent bag by the aid of perforations between adjacent side seals of adjacent bags.

5. The method of making product filled and sealed square ended bags comprising starting with a band being in the form of an elongated tube of flexible film, and thereafter completing the method set forth in claim 3.

6. The method of claim 1, wherein the forming of the closing seal legs includes forming the terminating ends of the closing seal legs with upturned portions.

7. The method of claim 1, comprising starting with a band being in the form of an elongated tube.

8. The method of claim 7, wherein the forming of the closing seal legs includes forming the terminus of the closing seal legs a distance from the upper edge of the back side of the top gusset to form a continuous tunnel in said longitudinally elongated portion.

9. The method of claim 7, including slitting the tube at the back side of the top gusset longitudinally at least adjacent the mouth of the bag to provide external access to the mouth of the bag.

10. The method of claim 3, including cutting off the longitudinally elongated portion of the top gusset outside of the seal legs.

11. The method of making product filled square ended bags including first making a chain of square ended bags as set forth in claim 7, and thereafter successively:

slitting the upper edge of the back half of the top gusset to provide access to said mouth:

filling each successive bag through the mouth with product and causing the front wall to separate from the back wall and the gussets to expand into top and bottom ends and expand into the side seal legs to form portions of the tube of film into sides of the bag: and separating the filled bag from the next adjacent bag.

12. The method of claim 11, including sealing the mouth of each successive bag after filling and before separating from the next adjacent bag.

* * * * *